US005887357A

United States Patent [19]

McNair

[11] Patent Number: 5,887,357

[45] Date of Patent: Mar. 30, 1999

[54] SHIELD FOR USE WITH HOODED HAIR DRYER

[76] Inventor: Wanda McNair, 5516 Boundbrook Ct., Virginia Beach, Va. 23462

[21] Appl. No.: 14,846

[22] Filed: Jan. 28, 1998

[51] Int. Cl.[6] ..... A45D 20/00

[52] U.S. Cl. ..... 34/99

[58] Field of Search ..... 34/96, 97, 98, 34/99, 100

[56] References Cited

U.S. PATENT DOCUMENTS

| | | | |
|---|---|---|---|
| 1,023,677 | 4/1912 | Pass | 2/173 |
| 1,698,533 | 1/1929 | Brown | 34/99 |
| 1,968,697 | 7/1934 | McComb | 2/174 |
| 2,568,399 | 9/1951 | Kahn | 2/174 |
| 4,704,744 | 11/1987 | Myers | 2/174 |
| 5,642,528 | 7/1997 | Dering | 2/174 |

*Primary Examiner*—Henry Bennett
*Assistant Examiner*—Pamela A. Wilson
*Attorney, Agent, or Firm*—MacMillan, Sobanski & Todd, LLC

[57] ABSTRACT

A flexible shield for enclosing a hood of a hair dryer about the head of a person having her hair dried, the shield both advantageously guiding air over the head and also protecting the face from exposure to heated air. The shield comprises a substantially flat panel prior to installation. When installed, the shield assumes a generally tubular configuration open at both ends and also having a lateral opening for admitting the neck of the hood. The upper opening is constricted by a drawstring and the lower opening has an elastic band for automatically constricting about the head of the user. The lower opening is maintained closed by a heat resistant snap fastener. Optionally, the shield has perforations disposed throughout to exhaust air which would otherwise escape through the lateral opening.

16 Claims, 4 Drawing Sheets

FIG. I

SHIELD FOR USE WITH HOODED HAIR DRYER

BACKGROUND OF THE INVENTION

1. Field of the Invention

The present invention relates to a flexible combined air guide and shield used by a person drying his or her hair with a hooded hair dryer. The shield is a flexible tube placed over the hood and head of the user. It is secured at one end at the hair line of the user and at the other end drawn tight over the hood of the hair dryer.

2. Description of the Prior Art

Hood type hair dryers have come into widespread use in commercial salons for drying freshly washed and newly serviced hair. The hood partially covers the head and discharges heated air against the hair. This air flows from the top of the hood downwardly, eventually escaping through a gap existing between the head and the hood.

Despite their widespread acceptance, these dryers have certain problems. One is that there is a conflict between comfort and effectiveness. The greater the heat and air flow, the more effective the dryer will be. However, excessive heat or air flow or both may subject the skin and face of the user to excessive and potentially injurious heat. If the heat and air flow are reduced, or if the gap between the hood and the head of the user is widened, drying times will be extended.

A shield adapted to cooperate with the hood of a hair dryer is seen in U.S. Pat. No. 4,704,744, issued to Janice L. Myers on Nov. 10, 1987. The device of Myers comprises a visor extending entirely around the head, and disposed roughly at the hair line. The visor is held in place by straps passing over the head. By contrast, the present invention comprises a generally tubular member passing over both the hood and the head of the user.

U.S. Pat. No. 1,698,533, issued to James C. Brown on Jan. 8, 1929, illustrates a hair treating apparatus forming a tube open at two ends in a manner generally similar to that of the present invention. However, the present invention includes a lateral slot allowing passage of the supply air tube of the dryer through the novel shield, and is fastened by elastic at one end and a draw cord at the other, unlike the device of Brown.

Other flexible shields are seen in U.S. Pat. No. 1,023,677, issued to Gretel J. Pass on Apr. 16, 1912, U.S. Pat. No. 1,968,697, issued to Lillian C. McComb on Jul. 31, 1934, U.S. Pat. No. 2,568,399, issued to Faith Hope Kahn on Sep. 18, 1951, and U.S. Pat. No. 5,642,528, issued to Helen A. Dering on Jul. 1, 1997.

None of the above inventions and patents, taken either singly or in combination, is seen to describe the instant invention as claimed.

SUMMARY OF THE INVENTION

The present invention is a shield and air guide used when drying hair with a conventional hooded, forced hot air hair dryer. A hooded hair dryer typically has a hollow, typically ovate or beehive shaped member adapted to envelope the user's head and to distribute heated air over the hair. The hollow member is connected to a supporting stanchion by a neck. Heated air enters the hollow member through the neck and is distributed over the hair.

The novel shield is placed over the hood, extending beyond the hood so as to constrict around the user's head below the hood when the novel shield is tightened. The shield thus closes a significant gap which would otherwise exist between the opening at the bottom of the hood and the user's head. Air which would ordinarily be discharged through the gap is redirected over the user's head and discharged from the side of the shield where the neck of the dryer enters the shield. The shield is readily placed over the hood and tightened. Tightening over the user's face is automatically accomplished due to the elastic band. Installation is thus quickly and easily performed.

Redirecting of the air has two significant advantages. One is that the user's face, which would otherwise be subjected to hot air, is spared discomfort and potential injury or drying effect arising from discharged hot air. The other is to maximize the drying effect of the hot air prior to discharging the same from the shield.

To these ends, the novel shield comprises a tube having a lateral opening for admitting the neck of the dryer to the interior of the tube. The upper edge of the shield has a drawstring for constricting the tube over the hood. The lateral opening is large enough both to pass the neck and also to allow air to exhaust from the hood. In an alternative embodiment, the lateral opening is supplemented by perforations which may be located along the tube. The lower edge of the shield has fastener and an elastic band for automatically constricting the tube against the head of the user below the hood.

The novel shield is readily fabricated from a flat panel of suitable of material, such as a thin synthetic resin. The upper edge of the panel bears a hem containing the drawstring, and the lower edge encloses an elastic band. The flat panel assumes a generally tubular configuration when wrapped around the hood and head of the user and the drawstring tied in this condition.

This construction enables the novel shield to be fabricated at such low cost as to be economically disposable after each usage. Disposal eliminates the need for washing for subsequent reuse, where reuse is permitted by municipal codes. In many jurisdictions, commercial reuse would not be acceptable.

Accordingly, it is one object of the invention to provide a shield for protecting a user's face from exposure to excessive heat from a hooded hair dryer.

It is another object of the invention to redirect heated air within a hooded hair dryer so as to maximize drying effect from the heated air.

It is a further object of the invention that the novel shield cooperate with conventional hooded hair dryers.

Still another object of the invention is that the novel shield be quickly and easily installed.

An additional object of the invention is that the shield be sufficiently economical to fabricate that users are willing to dispose of the shield after each usage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
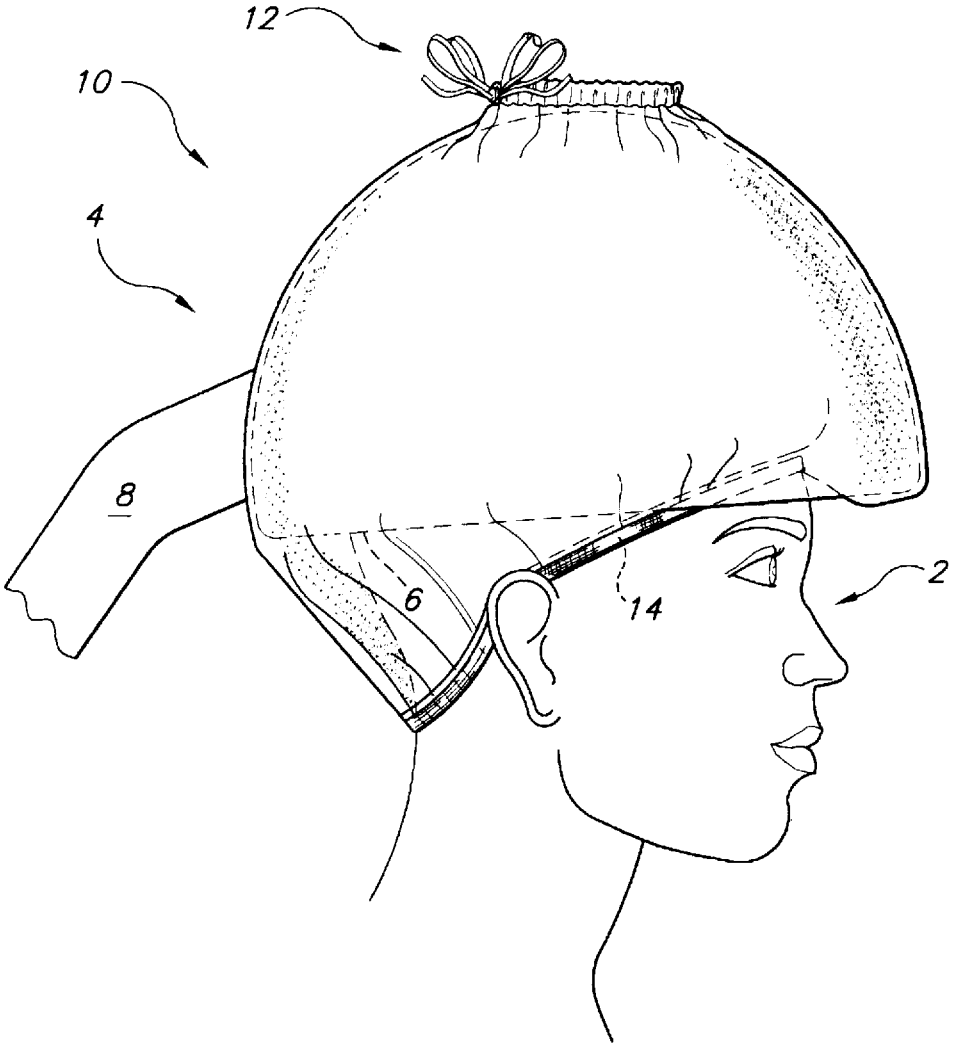
FIG. 1 is an environmental, side elevational view of the invention.

Turning now to FIG. 1 of the drawings, shield 10 is shown protecting a user 2 from hot air being discharged from a hooded hair dryer 4 (not shown in its entirety). When assembled as shown in FIG. 1, shield 10 partially encloses hood 6 and constricts about the head of user 2. Shield 10 is substantially closed at its upper end by a constrictable closure element such as draw string 12, and at the head of user 2 by a constrictable closure element such as elastic band 14 located along the bottom edge of shield 10. Shield 10 redirects air flow advantageously prior to discharge from dryer 4 by preventing immediate discharge of air from the bottom of hood 6, which discharge would occur in the absence of shield 10.

Figure 2:
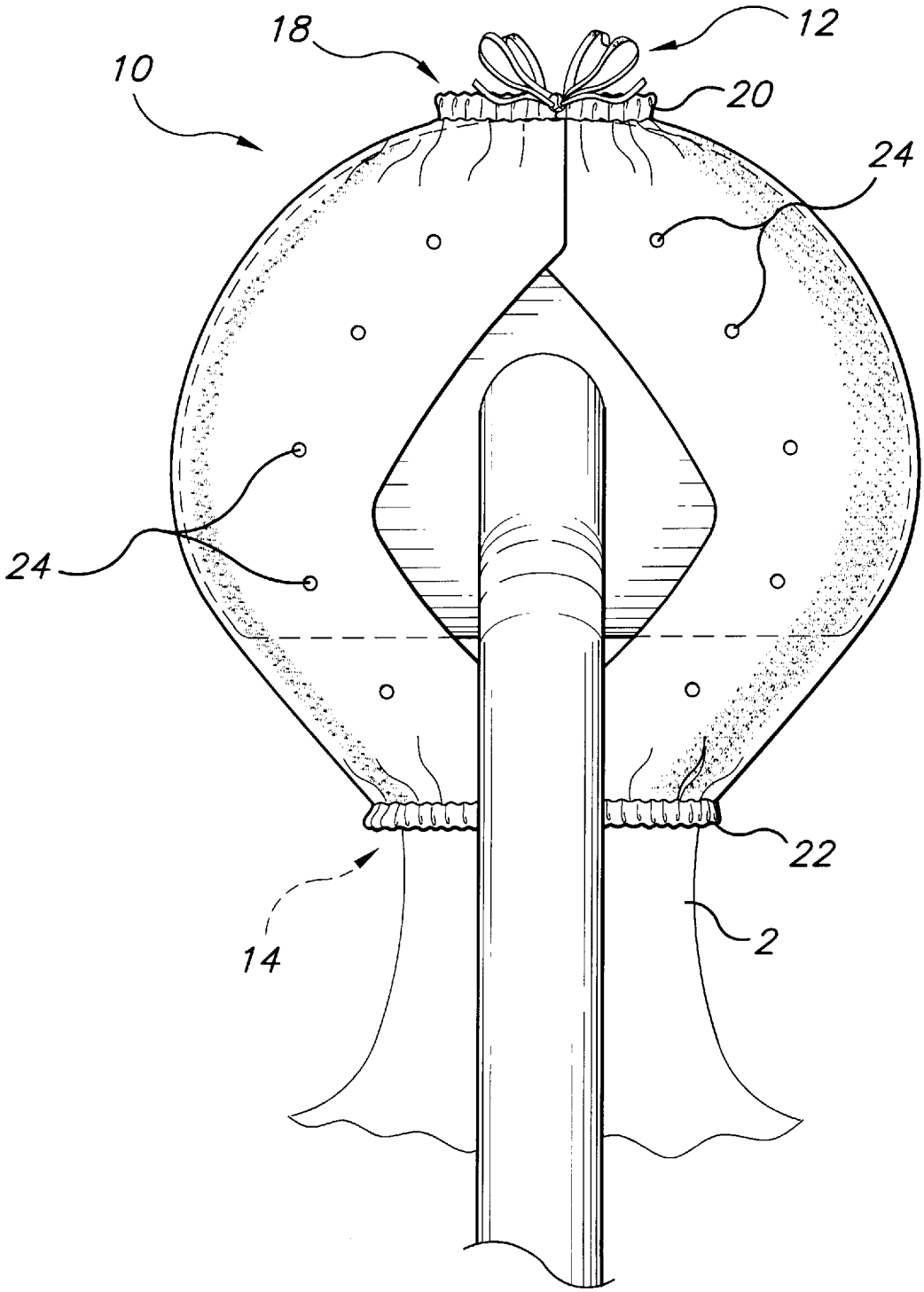
FIG. 2 is an environmental, rear elevational view of an alternative embodiment of the invention.

FIG. 2 illustrates an embodiment of the invention generally similar to that of FIG. 1, but having perforations 24 formed in shield 10 for allowing air to escape evenly over the extent of shield 10. FIG. 2 shows how shield 10 closes over hood 6 in a manner enabling passage of neck 8 which supports hood 6 on dryer 4. Shield 10 forms an opening 16 which passes neck 8 and which also enables air conducted into hood 6 through neck 8 to escape. Air which would escape from the bottom of hood 6 in the absence of shield 10 is advantageously redirected by shield 10, being forced to flow along the entire interior of hood 6 near the hair of user 2, prior to being discharged. Air is discharged from opening 16 and from opening 18, the latter being formed by incomplete sealing at hem 20 which retains draw string 12. Elastic band 14 is secured by being contained within a surrounding hem 22.

Figure 3:
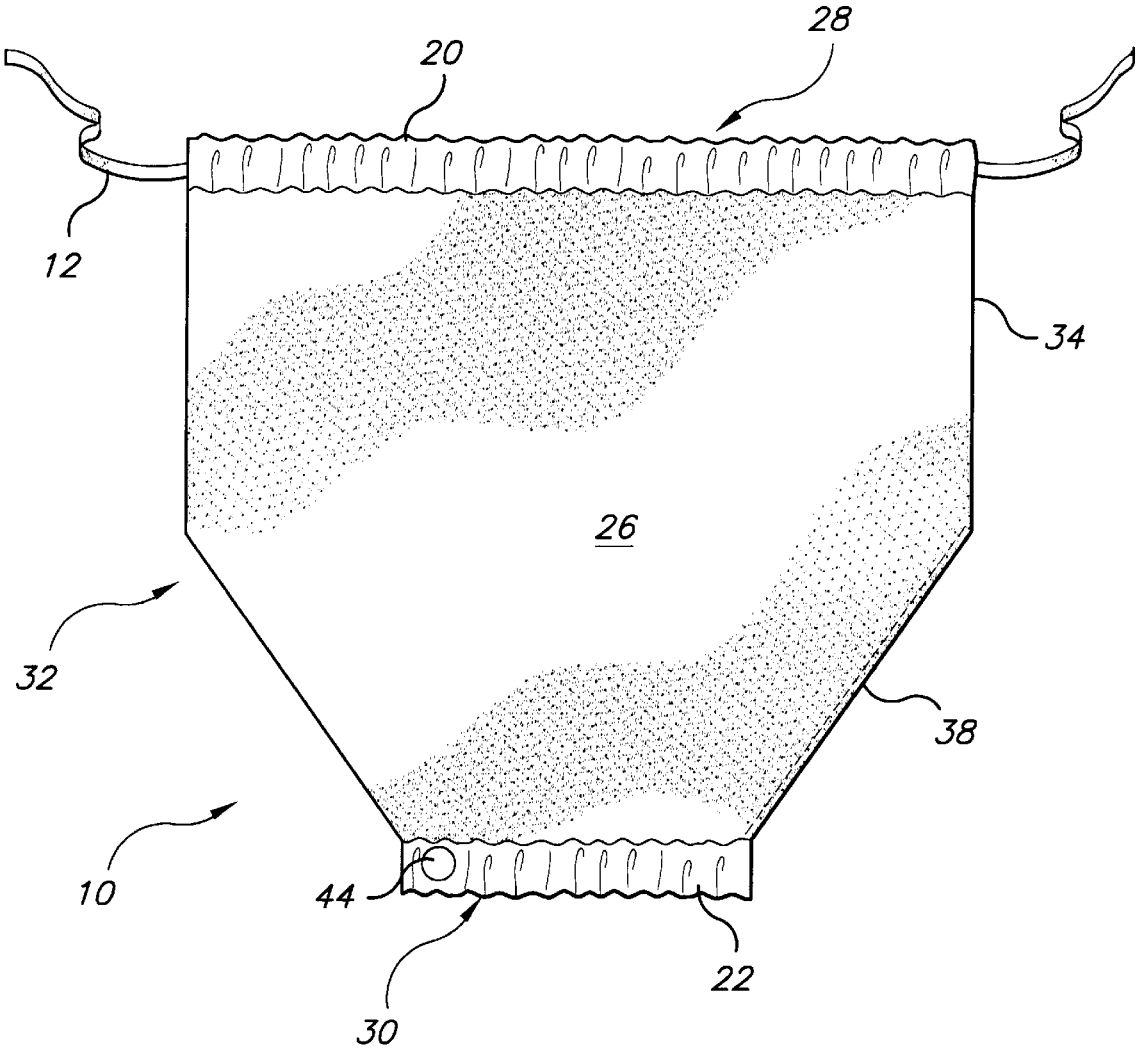
FIG. 3 is a side elevational view of the novel shield, the other side being a mirror image thereof.

FIG. 3 depicts a first side of the shield 10 as it would be spread out on a flat surface (not shown). A second side (not shown) is a mirror image of thereof and is integral with the first side along a fold described hereinbelow. Shield 10 comprises a flat flexible panel 26 having an upper edge 28 bearing hem 20 and drawstring 12 and lower edges 30 each bearing hem 22 and elastic band 14 and a fastening element 40, 44. The flat flexible panel 26 is folded along a lateral fold 34 and hemmed along relief 38. Lateral edges 32 and relief 36 form lateral opening 16 at the center of the lateral edges 32 and the reliefs 36, as shown in FIG. 2.

The assembled condition shown in FIG. 2 is maintained at upper edge 28 by tying draw string 12. However, at lower edge 30, elastic band 14 does not form a closed loop. To maintain closure in the assembled condition at the bottom of shield 10, a suitable fastener is provided. This fastener has a primary fastening element 40, such as the female member of a snap fastener, disposed at one end of shield 10 adjacent to hem 22. A complementing fastening element 44, such as the male member of a snap fastener, is disposed at opposed end of shield 10 adjacent to hem 22. Fastening elements 40, 44 each have a covering of heat resistant material, so that contact with the skin of user 2 will not cause burns.

Figure 4:
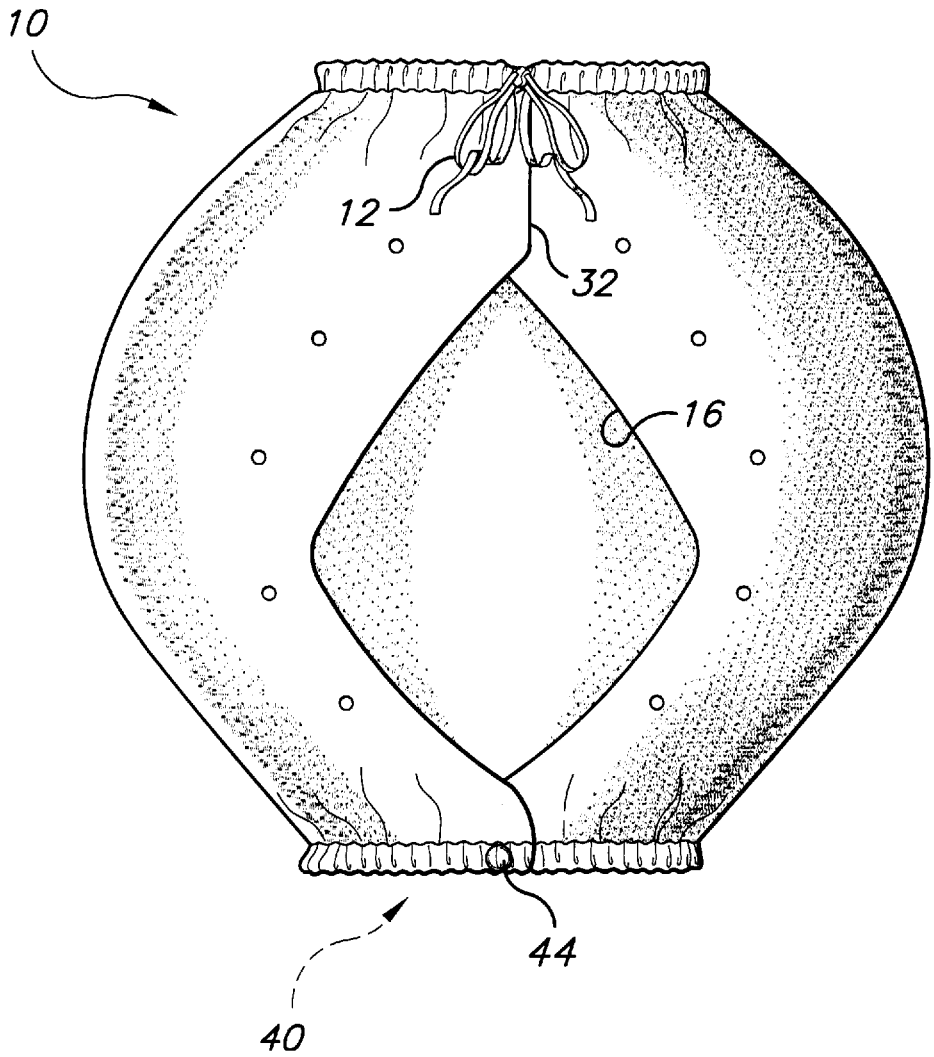
FIG. 4 is a rear elevational view of the embodiment of FIG. 2, shown in the assembled condition depicted in FIG. 2, environmental elements shown in FIG. 2 being omitted from FIG. 4.

FIG. 4 shows shield 10 in the assembled condition depicted in FIG. 2. Lateral edges 32 may overlap, providing access to the interior of shield 10 at opening 16. Closure is maintained by tying draw string 12 and by fastening fastening elements 40, 44.

The present invention is susceptible to variations and modifications which may be introduced without departing from the inventive concept. For example, elastic band 14 may be formed as a closed loop, if desired. Size and configuration of opening 16 may be varied to suit. Elastic band 14 and drawstring 12 may be substituted by other suitable fasteners.

It is to be understood that the present invention is not limited to the embodiments described above, but encompasses any and all embodiments within the scope of the following claims.

I claim:

1. A shield for protecting a user from hot air being discharged by a hooded hair dryer and for redirecting air flow advantageously prior to discharge from the hooded hair dryer, comprising a flat flexible panel having:

an upper edge having a first constrictable closure element disposed along said upper edge;

a lower edge having a second constrictable closure element disposed along said lower edge;

a left lateral edge disposed between said upper edge and said lower edge; and a right lateral edge disposed between said upper edge and said lower edge, said left lateral edge and said right lateral edge being configured and dimensioned such that when said left lateral edge abuts said right lateral edge, a lateral opening is formed at the center of said left lateral edge and said right lateral edge through which air may be guided and discharged.

2. The shield according to claim 1, said lower edge having a first end adjacent said second constrictable closure, a primary fastening element disposed at said first end, and an opposed second end and a complementing fastening element disposed at said second end.

3. The shield according to claim 2, said primary fastening element and said complementing fastening element each having a covering of heat resistant material, whereby contact of said primary fastening element and said complementing fastening element with the skin of a user will not cause burns.

4. The shield according to claim 1, said first constrictable closure element comprising a first hem located along said upper edge and a drawstring contained within said first hem, and said second constrictable closure element comprising an elastic band located along and secured at said lower edge.

5. The shield according to claim 4, said elastic band forming a closed loop.

6. The shield according to claim 1, said flat flexible panel having perforations formed therein.

7. The shield according to claim 1, said flexible panel being configured and dimensioned such that said upper edge may be drawn over the hood of the dryer, and tightened by said first constrictable closure.

8. The shield according to claim 1, said flat flexible panel having:

a first side and a second side, said flat flexible panel folded along a lateral fold, said second side integral with said first side along said lateral fold;

a first relief disposed between and spanning said lateral fold and said lower edge, said flexible panel hemmed along said first relief; and a second relief disposed between and spanning each said left lateral edge and said right lateral edge.

9. A shield for protecting a user from hot air being discharged by a hooded hair dryer and for redirecting air flow advantageously prior to discharge from the hooded hair dryer, comprising a flat, perforated, flexible panel having:

an upper edge having a hem disposed along said upper edge and a drawstring contained within said first hem;

a lower edge having an elastic band located along and secured at said lower edge;

a left lateral edge disposed between said upper edge and said lower edge; and a right lateral edge disposed between said upper edge and said lower edge, said left lateral edge and said right lateral edge configured and dimensioned such that when said left lateral edge abuts said right lateral edge, a lateral opening is formed at the center of said left lateral edge and said right lateral edge through which air may be guided and discharged, said lower edge having a first end adjacent said elastic band, a primary fastening element disposed at said first end, and an opposed second end and a complementing fastening element disposed at said second end, said primary fastening element and said complementing fastening element each having a covering of heat resistant material, whereby contact of said primary fastening element and said complementing fastening element with the skin of a user will not cause burns.

10. The shield according to claim 9, said flexible panel being configured and dimensioned such that said upper edge may be drawn over the hood of the dryer, and tightened by said drawstring.

11. The shield according to claim 9, said flat flexible panel having:

a first side and a second side, said flat flexible panel folded along a lateral fold, said second side being integral with said first side along said lateral fold;

a first relief disposed between and spanning said lateral fold and said lower edge, said flexible panel hemmed along said first relief; and a second relief disposed between and spanning each said left lateral edge and said right lateral edge.

12. The shield according to claim 9, said flat flexible panel having perforations formed therein.

13. The shield according to claim 9, said elastic band forming a closed loop.

14. A shield for protecting a user from hot air being discharged by a hooded hair dryer and for redirecting air flow advantageously prior to discharge from the hooded hair dryer, comprising a flat, perforated, flexible panel having:

a first side and a second side, said flat flexible panel folded along a lateral fold, said second side being integral with said first side along said lateral fold;

an upper edge having a hem disposed along said upper edge and a drawstring contained within said first hem, said flexible panel being configured and dimensioned such that said upper edge may be drawn over the hood of the dryer, and tightened by said drawstring;

a lower edge having an elastic band located along and secured at said lower edge;

a left lateral edge disposed between said upper edge and said lower edge; and a right lateral edge disposed between said upper edge and said lower edge, said left lateral edge and said right lateral edge configured and dimensioned such that when said left lateral edge abuts said right lateral edge, a lateral opening is formed at the center of said left lateral edge and said right lateral edge through which air may be guided and discharged;

a first relief disposed between and spanning said lateral fold and said lower edge, said flexible panel hemmed along said first relief;

a second relief disposed between and spanning each said left lateral edge and said right lateral edge, said first and second reliefs being convergent;

said lower edge having a first end adjacent said elastic band, a primary fastening element disposed at said first end, and an opposed second end and a complementing fastening element disposed at said second end, said primary fastening element and said complementing fastening element each having a covering of heat resistant material, whereby contact of said primary fastening element and said complementing fastening element with the skin of a user will not cause bums.

15. The shield according to claim 14, said flat flexible panel having perforations formed therein.

16. The shield according to claim 14, said elastic band forming a closed loop.

* * * * *